US005726513A

United States Patent [19]

Lyle et al.

[11] Patent Number: 5,726,513

[45] Date of Patent: Mar. 10, 1998

[54] MOTOR GOVERNOR MOUNTING ASSEMBLY

[75] Inventors: David M. Lyle; Adam L. Boren, both of McMinnville, Tenn.; David W. Hale, Phoenix, Ariz.

[73] Assignee: MagneTek, Inc., Nashville, Tenn.

[21] Appl. No.: 680,596

[22] Filed: Jul. 12, 1996

[51] Int. Cl.[6] ..... H01H 38/14

[52] U.S. Cl. ..... 310/91; 310/66; 310/67 R

[58] Field of Search ..... 310/91, 66, 67 R, 310/68 E; 200/80 R, 557, 61, 46, 553; 318/325, 462; 73/535–539

[56] References Cited

U.S. PATENT DOCUMENTS

| | | | |
|---|---|---|---|
| 2,583,590 | 1/1952 | Osterhus | 200/80 |
| 2,991,340 | 7/1961 | Bickham | 200/80 |
| 3,532,841 | 10/1970 | Hackbardt | 200/80 |
| 4,593,163 | 6/1986 | Fisher | 200/80 |
| 4,885,440 | 12/1989 | Kachuk | 200/80 |

*Primary Examiner*—Steven L. Stephan
*Assistant Examiner*—Nguyen Tran Ngoc
*Attorney, Agent, or Firm*—Waddey & Patterson; I. C. Waddey, Jr.

[57] ABSTRACT

An improved connection assembly for connecting a centrifugal governor to the shaft of a fractional horsepower electric motor. The end of the rotor shaft to which the governor is mounted is provided with a circumferential ring seat and is flattened on diametrically opposed sides at the tip of the shaft. The governor assembly carrier plate is provided with a mounting sleeve that is shaped to mate with the flattened sides at the end of the rotor shaft. The mounting sleeve also has an opening that mates with the circumferential ring seat so that when the carrier plate is placed over the end of the rotor shaft, the carrier plate and the rotor shaft can be rotated 90 degrees relative to each other and the carrier plate will be captured by the ring seat to hold the governor assembly in place. A bowed retaining ring is also fitted within the ring seat and between the governor and the stator of the motor forcing the carrier plate of the governor assembly toward the end of the shaft. To lock the governor fixedly in place relative to the rotor shaft, a clip is provided which fits about the end of the shaft with an opening which mates with the portion of the end of the shaft having the two flat sides. The clip has cuffed ends which clip over the carrier plate. Thus, the curled ends attach to the carrier plate and the shape of the opening of the clip prevent the governor from slipping relative to the rotor shaft.

7 Claims, 2 Drawing Sheets

MOTOR GOVERNOR MOUNTING ASSEMBLY

BACKGROUND OF THE INVENTION

Our invention relates to a fractional horsepower motor assembly and in particular, to a centrifugal governor mounted to the rotor shaft of the motor with improved means for connecting the governor to the rotor shaft. Our connector locks the governor to the rotor shaft to prevent slippage between the two as the rotor shaft accelerates to operating speed, but the design of our connector makes it quick and simple to disconnect, thus enabling a repair person to quickly and easily gain access to the bearing and other working parts of the motor for repair. Further, the improved connector makes original assembly of the motor and the governor attached to it easier, less costly and less time consuming.

Our invention is an improvement to the governor and motor assembly described and illustrated in U.S. Pat. No. 4,885,440 issued to Kachuk and presently licensed to the assignee of this application. The disclosure of U.S. Pat. No. 4,885,440 is incorporated herein by reference for purposes of describing the background of this invention, the environment in which the present invention operates, and the associated prior art.

In the Kachuk patent on his governor and motor assembly, the problems associated with connecting the governor switch and its associated components to the motor housing by individual mounting hardware is discussed at column 1, beginning at line 46. Kachuk eliminates the need for individual mounting hardware by designing his governor and related components for positioning such that the terminal board maintains the capacitor, switch and governor in place while utilizing only the mounting hardware for the terminal board.

In practice, we have found that the Kachuk structure and method, while a significant improvement over the prior art, continues to exhibit limited deficiencies. Specifically, the Kachuk mounting structure could allow the governor to slip relative to the shaft of the motor, particularly if there is any significant friction on the face by the plunger of the switch against the actuating arm. Further, when the governor is mounted onto the rotor shaft of the motor at the time of original manufacture, and more particularly at the lime of repair of the motor in the field, the absence of some positive mounting relationship between the governor and the shaft can cause the governor, when placed on the shaft, to become misaligned, or, depending upon the position of the motor (particularly in the field at the time of repair service), to cause the governor to drop off of the shaft of the motor.

Thus, while the desire for a governor that can be quickly and easily mounted to a rotor shaft and can be conveniently and easily removed and replaced for in field service is both desired and necessary, there is a further need that is yet unsatisfied by the prior art for a device that will provide these features while at the same time allowing for a controlled connection between the governor and the shaft in order to keep it from becoming displaced.

SUMMARY OF THE INVENTION

Our invention is an improved connection assembly for connecting a centrifugal governor to the shaft of a fractional horsepower electric motor. The end of the rotor shaft to which the governor is mounted is provided with a circumferential ring seat and is flattened on diametrically opposed sides at the tip of the shaft. The governor assembly carrier plate is provided with a mounting sleeve that is shaped to mate with the flattened sides at the end of the rotor shaft. The mounting sleeve also has an opening that mates with the circumferential ring seat so that when the carrier plate is placed over the end of the rotor shaft, the carrier plate and the rotor shaft can be rotated 90 degrees relative to each other and the carrier plate will be captured by the ring seat to hold the governor assembly in place. A bowed retaining ring is also fitted within the ring seat and between the governor and the stator of the motor forcing the carrier plate of the governor assembly toward the end of the shaft. To lock the governor fixedly in place relative to the rotor shaft, a clip is provided which fits about the end of the shaft with an opening which mates with the portion of the end of the shaft having the two flat sides. The clip has curled ends which clip over the carrier plate. Thus, the curled ends attach to the carrier plate and the shape of the opening of the clip prevent the governor from slipping relative to the rotor shaft.

DESCRIPTION OF THE PREFERRED EMBODIMENT

Figure 1:
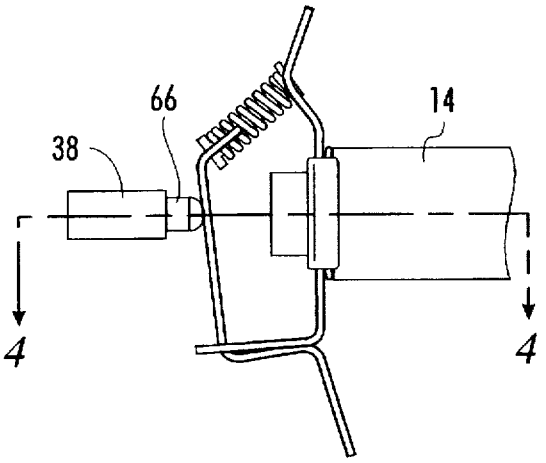
FIG. 1 is a side view of the rotor shaft of a motor, the governor with the improved mounting assembly in place and the governor in the at rest position.
Figure 3:
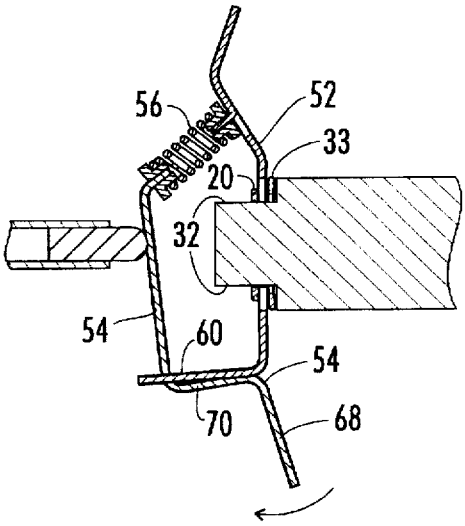
FIG. 3 is a cross-sectional view of the structure shown in FIG. 1 viewed from the same direction as FIG. 1.
Figure 2:
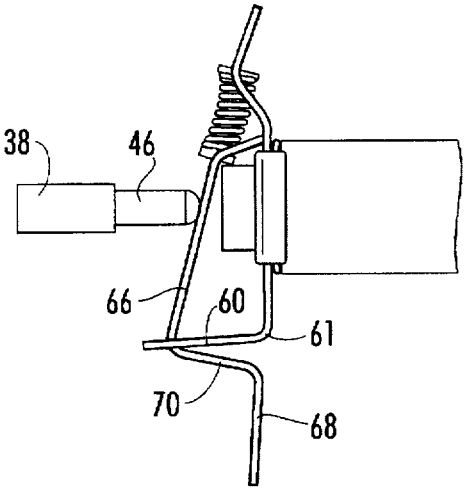
FIG. 2 is a side view identical to FIG. 1 except that the governor switch is shown in the activated position.

The present invention will be best understood upon review of the preferred embodiment of the invention as illustrated in FIGS. 1–6 in the accompanying drawings wherein like reference to like parts.

As can be seen from the accompanying figures, the present invention is improved mounting structure for attaching a centrifugal governor assembly to the end of the rotor shaft of a fractional horsepowered electric motor. Except for the mounting structure, the centrifugal governor assembly of our invention is substantially the same as the centrifugal governor assembly illustrated in the U.S. Pat. No. 4,885,440, the disclosure in which is incorporated herein by reference for purposes of describing the field of invention, the use of a centrifugal governor on a fractional horsepower electric motor, and the function that the governor serves. Where possible, this application will employ the same reference numerals as are employed in the '440 patent.

As can be seen from the drawings, the centrifugal governor assembly 50 is attached to the end of the rotor shaft 14. The centrifugal governor assembly 50 includes a carrier plate 52 and a lever 54. As best seen from FIG. 5, the carrier plate 52 has a flat intermediate section 53 with a fulcrum 60 connected at one end 61 to one end of the flat intermediate section and extending perpendicularly from the flat section. Spaced from the one end 61 of the fulcrum 60 is a mounting port 62 shaped to receive the lever 54. Lever 54 includes the actuating arm 66 and extension 68 with elbow 70 extending from one end of the actuating arm 66 to extension 68 and connects the two elements.

To assemble the governor assembly 50, the lever 54 is inserted through the mounting port 62 with the actuating arm 66 extending between the end of the rotor shaft 14 and the actuator pin 46. Elbow 70 and extension 68 are on opposite sides of the fulcrum 60 from the actuating arm 66 so that the point of intersection of the lever 54 with the carrier plate 52 creates a fulcrum point for the governor assembly 50. Since the extension 68 is radially spaced from the fulcrum point, it serves as a pendulum, which creates a momentum in response to rotation of the rotor shaft 14 and as the speed of rotation increases, the momentum causes the lever 54 to rotate about the fulcrum point in the direction of the arrow shown in FIG. 3. Rotation of the lever 54 causes the actuating arm to overcome the force of the compression spring 56 and collapse it, allowing the actuator pin 46 to extend to the position shown in FIG. 2, thus disconnecting the motor switch 38 to shut down the start windings of the single phase motor to which the governor assembly is connected.

When the motor is started, there is an immediate acceleration of the centrifugal governor to a high rpm, and there can be slippage between the centrifugal governor 50 and the rotor shaft 14. To overcome this problem, Applicants have developed an improved mounting assembly.

Applicants' mounting assembly including a ring seat 30 (sometimes referred to herein as an "annular groove") extending circumferentially about the end of the shaft 14 creating a lip 31 about the perimeter of the rotor shaft, spaced slightly inwardly from the end of the rotor shaft. Opposing sides of the end of the rotor shaft are also planed or formed to create parallel flat surfaces 32 which extend from the end of the rotor shaft back to the ring seat 30. Hole 58 passing through the carrier plate 52 has an elongated shape with a rounded center portion. When the carrier plate 52 is positioned so that the elongated shape of the hole 58 is aligned to match the shape of the end of the rotor shaft 14 as shown in dotted lines in FIG. 6, the carrier plate 52 will slip over the end of the rotor shaft.

Prior to placement of the carrier plate 52 over the rotor shaft, a bowed retaining ring 33 is slipped about the rotor shaft 14, seated in the ring seat 30. The bowed retaining ring 33 is slightly spring loaded by virtue of the bow in its profile and does not lie in a flat plane. Thus, once the bowed retaining ring 33 is in place, when the carrier plate 52 is placed over the end of the rotor shaft 14 and the rotor shaft is in the position shown in dotted lines in FIG. 6, the carrier plate 52 must be pressed against the force of the bowed retaining ring 33 to allow the carrier plate to fit within the annular groove. With pressure on the carrier plate being applied against the bowed retaining ring, the rotor shaft 14 and carrier plate are rotated relative to each other by 90° into the position shown in full lines in FIG. 6. At this point, the circular center portion of the opening 58 fits into the annular groove 30 and behind the lip 31 to hold the centrifugal governor assembly on the end of the rotor shaft 14.

To prevent slippage between the carrier plate 52 and the rotor shaft 14 when the motor is started up, the clip 20 of the present invention is installed. The clip 20 fits between the carrier plate 52 and the actuating arm 66 of the lever 54 and has an elongated opening 59 that mates with the elongated shape of the end of the rotor shaft 14. Clip 20 has a nose 22 which fits over and engages the edge 24 of the carrier plate 52. The clip can then be pushed down over the end of rotor shaft 14 with the elongated opening 59 of the clip 20 fitting over the flattened sides 32 of the rotor shaft. On the end of the clip 20 opposite the nose 22 is a finger 26 which will fit over the opposite edge 28 of the carrier plate 52. The finger 26 can thus be clipped onto the opposite edge 28 of the carrier plate 52 and hold the clip 20 in place.

Figure 4:
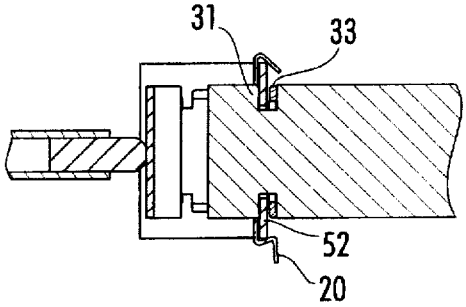
FIG. 4 is a cross-sectional view taken on a line 44 of FIG. 1.
Figure 5:
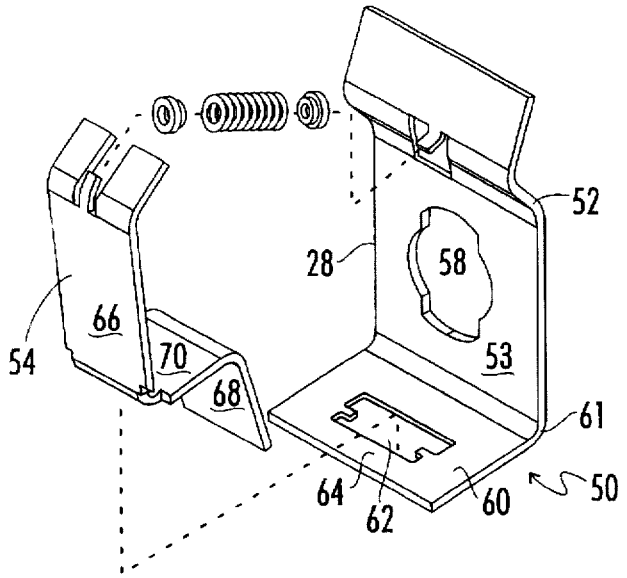
FIG. 5 is an exploded perspective view of the governor assembly.

As can be seen from FIG. 4, the clip 20 is fixed relative to the carrier plate 52 by the shape of the opposing sides of the clip 20 mating with the opposing edges of the carrier plate. The elongated opening 59 of the clip 20 fits snugly about the flattened sides 32 of the rotor shaft 14, thus fixing the clip relative to the rotor shaft and thereby preventing any relative movement between the centrifugal governor assembly 50 and the rotor shaft 14. The bowed retaining ring 33 presses the carrier 52 against the lip 31 of the ring seat 30 to keep the system from sliding rearwardly toward the stator of the motor, thereby prohibiting the clip 20 from slipping into the ring seat and rotating relative to the rotor shaft 14. It will be understood by those skilled in the art that the shapes of the openings in the carrier plate and the clip are designed to mate with the shape of the cross-section profile of the end of the rotor shaft, and that the shape can be varied within the scope of the invention. Thus, for example, if the end of the rotor shaft were flattened on one side only, then the openings in the carrier plate and clip would be shaped to mate with that specific shape of the shaft. Applicants consider the ring seat to constitute a first profile when viewed in cross-section perpendicular to the axis of the rotor shaft; the end of the rotor shaft between the free end of the shaft and the ring seat, when viewed in cross-section at any point along that distance, to be a second profile; and the shape of the opening in the carrier plate to be a third profile. The third profile is a combination of the first and second profiles, if they were superimposed on each other with the axis of the rotor shaft passing through each of the first and second profiles being concentric.

Figure 6:
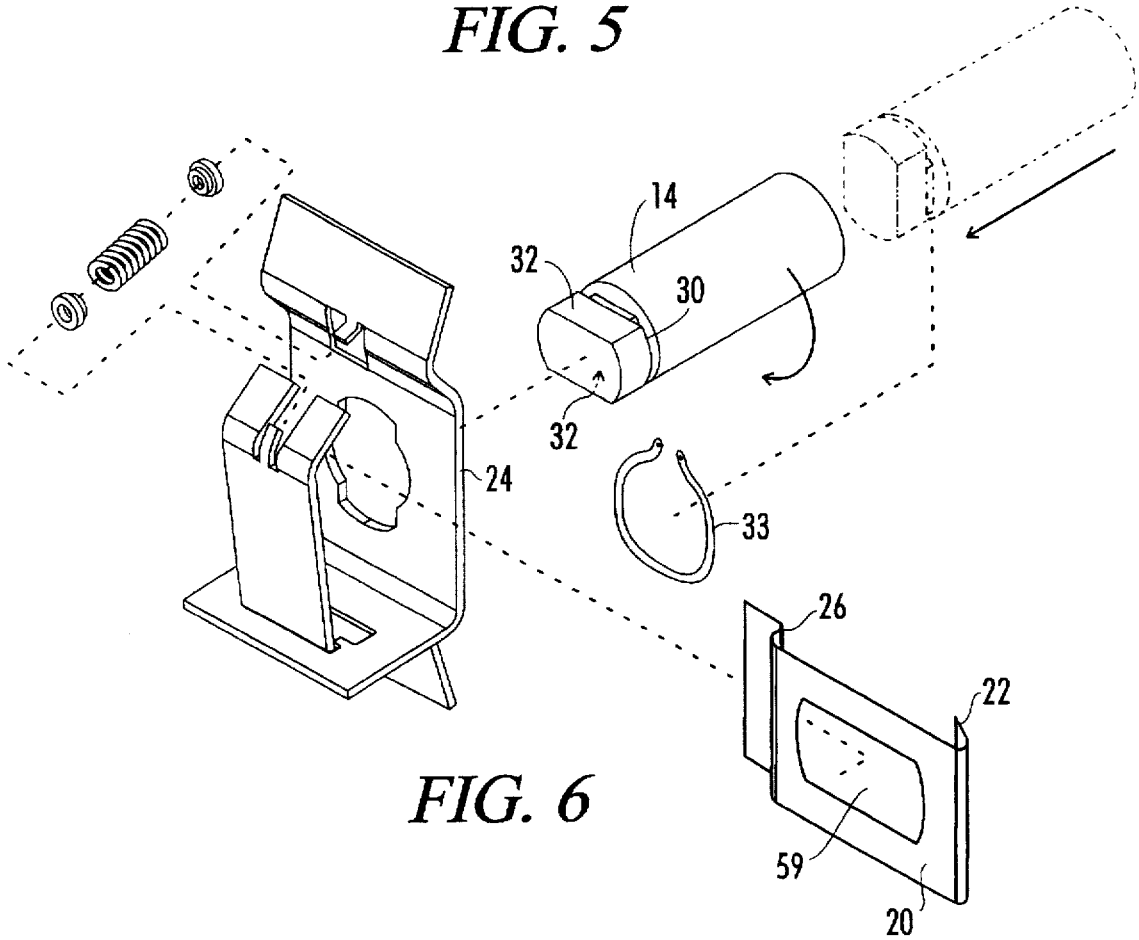
FIG. 6 is an exploded perspective view of the governor assembly with the bowed retaining ring and securing clip of the present invention.

In assembly of the motor, once the carrier plate has been placed over the end of the rotor shaft and rotated into the connected position as shown in full lined in FIG. 6, the clip 20 is simply slipped between the carrier plate 52 and the lever 54, fitted over the end of the rotor shaft 14 and snapped into place by the finger 26 fitting over the edge 28 of carrier plate 52. At this point, the motor and governor assembly is assembled and ready to ship.

In the event that there is a problem with the motor and repair in the field is required, the service person can simply take the cover off of the end of the motor, place his or her finger underneath the finger 26 of the clip 20 and pop it up over the edge 28 of the carrier plate 52 to release the clip. Because the end of the rotor shaft 14 protrudes into the hole 59 of the clip, in practically every instance, the clip will simply hang on the end of the shaft and not drop off of the shaft and be lost or misplaced. This will allow the repair person to then grip the clip 20 and raise it up over the shaft 14 and pull it backwards toward the edge 24 of the carrier plate 52. At this point, the centrifugal governor assembly 50 is free to rotate relative to the rotor shaft 14, and the repair person simply holds the drive end of rotor shaft 14 in one hand and twists the governor assembly 50 90° to align the elongated portion of the hole 58 in the carrier plate 52 with the flattened elongated shape of the end of the rotor shaft 14 that is shown in dotted lines in FIG. 6 and pulls the centrifugal governor assembly 50 axially away from the rotor shaft to remove it.

Once the centrifugal governor assembly 50 has been removed from the rotor shaft, the system can be opened up to replace worn bearings and the like or to make other repairs to the motor with minimum effort. This entire disassembly can be quickly and easily accomplished without the problems associated with lost parts, etc. Once the machine has been repaired the procedure is simply reversed to quickly reassemble the machine, all of which will take a minimum amount of time therefore a minimum expense to the customer.

Thus, Applicant's invention provides a connection assembly for a fractional horsepower electric motor and its centrifugal governor that is easily and quickly switched between a connected and a disconnected configuration but, when in a connected configuration, is held fast against rotational or axial movement. The device is simple to manufacture, inexpensive to manufacture, easy to assemble, easy to disassemble and reassemble, and effective for its intended use.

Although there have been described particular embodiments of the present invention of a new and useful improved governor mounting assembly, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An improved mounting assembly for mounting a centrifugal governor to an electric motor, said electrical motor having a rotor shaft extending from the motor stator and terminating at a free end, said rotor shaft having an axis, and said centrifugal governor including a carrier plate and a lever with the lever hingedly connected to said carrier plate for toggle movement of said lever in response to centrifugal force created by rotation of said governor, the toggle movement of said lever operating a switch between an activated and an at rest position depending upon the speed of rotation of the centrifugal governor, the improved mounting assembly including:

a. a ring seat extending peripherally about said rotor shaft and spaced a predetermined distance from the free end of said rotor shaft, said ring seat having a first profile when viewed in a plane perpendicular to the axis of said rotor shaft;

b. the portion of said rotor shaft between said free end and said ring seat being shaped to have a second profile which is the same shape when viewed in cross section at any point perpendicular to the axis of said rotor shaft from said free end to said ring seat;

c. an opening in said carrier plate having a third profile substantially identical to the shape defined by the combination of said second profile overlying said first profile, said opening enabling said governor assembly to be mounted to said rotor shaft by inserting the free end of said rotor shaft in said opening and sliding said carrier plate along said shaft until said carrier plate overlies said ring seat, enabling said governor assembly to be affixed to said rotor shaft by then rotating said carrier plate relative to said rotor shaft; and d. a clip fitted over said carrier plate and releasable engaged therewith, said clip having a hole through it, said hole having a shape substantially the same as said second profile, said hole positioned to receive the free end of said rotor shaft after said rotor shaft has been inserted through and rotated relative to said carrier plate to thereby prevent rotational movement of said governor assembly relative to said rotor shaft while said clip is connected to said carrier plate.

2. The improved mounting assembly of claim 1 wherein said first profile is annular.

3. The improved mounting assembly of claim 1 wherein said second profile is created by forming a flat face extending axially along said rotor shaft.

4. The improved mounting assembly of claim 1 wherein said second profile is created by flat surfaces on opposing sides of said shaft and extending axially along the length thereof.

5. The improved mounting assembly of claim 1 further including a bowed retaining ring mounted in said ring seat between the motor stator and the centrifugal governor to flexibly press said carrier plate against said ring seat.

6. The improved mounting assembly of claim 1 wherein said clip has a planer center section with opposing ends with a nose on one end and a finger on the other end.

7. The improved mounting assembly of claim 6 wherein said carrier plate has opposing edges and said nose and finger are shaped to mate with said opposing edges of said carrier plate, said nose and said finger of said clip are shaped to mate with opposing edges of said carrier plate.

* * * * *